US006123414A

United States Patent [19]

Choi

[11] Patent Number: 6,123,414

[45] Date of Patent: Sep. 26, 2000

[54] APPARATUS FOR INJECTING A RECORDING SOLUTION OF A PRINT HEAD USING PHASE TRANSFORMATION OF THIN FILM SHAPE MEMORY ALLOY

[75] Inventor: Hae Yong Choi, Kyunggi-do, Rep. of Korea

[73] Assignee: Samsung Electro-Mechanics Co., Ltd., Kyunggi-do, Rep. of Korea

[21] Appl. No.: 08/978,003

[22] Filed: Nov. 25, 1997

Related U.S. Application Data

[60] Provisional application No. 60/040,181, Mar. 12, 1997.

[51] Int. Cl.[7] ..... B41J 2/04

[52] U.S. Cl. ..... 347/54

[58] Field of Search ..... 347/55, 54, 103, 347/68, 70, 71, 154, 123, 111, 159, 127, 128, 17, 141, 120, 151, 84

[56] References Cited

U.S. PATENT DOCUMENTS 5,825,383 10/1998 Abe et al. ..... 347/54

FOREIGN PATENT DOCUMENTS 57-203177 12/1982 Japan .
63-57251 3/1988 Japan .
2-265752 10/1990 Japan .
2-308466 12/1990 Japan .
3-65349 3/1991 Japan .
4-247680 9/1992 Japan .

*Primary Examiner*—John Barlow
*Assistant Examiner*—Raquel Yvette Gordon
*Attorney, Agent, or Firm*—Lowe Hauptman Gopstein Gilman & Berner

[57] ABSTRACT

In an apparatus for injecting a recording solution of a print head, a buckling force of a thin film shape memory alloy is increased by a pressure lower than an atmospheric pressure when the thin film shape memory alloy is cooled down to be buckled to its initial state. Thus, time taken for refilling a liquid chamber after the recording solution is injected, i.e., an operating frequency, is increased to enhance printing performance. The apparatus includes the thin film shape memory alloys of a shape memory alloy having a phase transformed by a temperature variation, an electric power supply section for inciting the temperature variation of the thin film shape memory alloys, a substrate having space portions in a state of being lower than the atmospheric pressure for forcibly phase-transforming the thin film shape memory alloy when they are coupled thereto, a passage plate which is installed over the thin film shape memory alloys, is formed with liquid chambers for retaining the recording solution and is formed with a feed path in one sides of wall planes surrounding the liquid chambers for introducing the recording solution, and a nozzle plate installed over the passage plate and formed with nozzles having dimensions smaller than those of the liquid chambers of the passage plate for enabling the recording solution to be injected in the form of droplet when the phase of the thin film shape memory alloys is transformed.

22 Claims, 12 Drawing Sheets

(heating time)

(cooling time)

APPARATUS FOR INJECTING A RECORDING SOLUTION OF A PRINT HEAD USING PHASE TRANSFORMATION OF THIN FILM SHAPE MEMORY ALLOY

This application claims benefit of Provisional Application No. 60/040,181, filed Mar. 12, 1997.

BACKGROUND OF THE INVENTION

1. Field of the Invention

The present invention relates to an apparatus for injecting a recording solution of a print head, and more particularly to an apparatus for injecting a recording solution of a print head, wherein, a pressure of a liquid chamber is regulated by means of deformation induced during the phase transformation of a thin film shape memory alloy, and the thin film shape memory alloy is buckled while being drawn by a pressure lower than an atmospheric pressure, thereby increasing operating frequency to enhance printing performance, enable to manufacture products of small size and simplify a manufacturing process.

2. Description of the Prior Art

Widely available print heads generally utilize a Drop On Demand (DOD) system. The DOD system has been increasingly employed since the printing operation is easily performed by instantaneously injecting bubbles of recording solution under the atmospheric pressure neither requiring the charge or deflection of the bubbles of the recording solution nor demanding high pressure. A heating-type injecting method using a resistor and a vibrating-type injecting method using a piezo-electric device may be given as the representative injecting principles.

FIG. 1 is a view for explaining the heating-type injecting method, in which a chamber a1 retains a recording solution therein, an injection hole a2 directing from chamber a1 toward a recorded medium is provided, and a resistor a3 is embedded into the bottom of chamber a1 to be opposite to injection hole a2 to incite expansion of air. By this construction, the air bubbles expanding by resistor a3 are to forcibly push the recording solution within the interior of chamber a1 through injection hole a2, and the recording solution is injected toward the recorded medium by the pushing force.

In terms of the heating-type injecting method, however, the recording solution is heated to cause a chemical change. Furthermore, the recording solution adversely adheres onto the inner circumference of injection hole a2 to clog it. In addition to a drawback of short durability of the heat-emitting resistor, the water-soluble recording solution should be utilized to degrade maintainability of a document.

FIG. 2 is a view for explaining the vibrating-type injecting method by means of the piezo-electric device, which is constructed by a chamber b1 for retaining a recording solution, an injection hole b2 directing from chamber b1 toward a recorded medium, and a piezo transducer buried into the bottom of the opposite side of injection hole b2 for inciting vibration.

Once piezo transducer b3 incites vibration at the bottom of chamber b1, the recording solution is forcibly pushed out through injection hole b2 by the vibrating force. Consequently, the recording solution is injected onto the recorded medium by the vibrating force.

Without using the heat, the injecting method by means of the vibration of the piezo transducer is advantageous of selecting a variety of recording solutions. However, the processing of the piezo transducer is difficult and, especially, the installing of the piezo transducer attached to the bottom of chamber b1 is a demanding job to be detrimental to mass production.

Additionally, the conventional print head employs a shape memory alloy for issuing the recording solution. Japanese Laid-open Patent Publication Nos. sho 57-203177, sho 63-57251, hei 4-247680, hei 2-265752, hei 2-308466 and hei 3-65349 disclose examples of print heads employed with shape memory alloys. The conventional examples are constructed to be bending-deformed by joining several sheets of shape memory alloys respectively having different phase transforming temperatures and different thicknesses or by joining an elastic member with a shape memory alloy.

However, the conventional print head using the shape memory alloy involves a difficulty in shrinking the head dimension, an inferior nozzle compactness to degrade resolution and a demanding job in its fabrication, thereby negatively affecting mass production. Also, the shape memory alloy used therein is embodied by a thick layer having a thickness of more than 50 $\mu$m instead of incorporating with a thin film. Therefore, it dissipates greater electric power during a heating operation and requires longer cooling time to be disadvantageous of resulting in degraded operating frequency and slow printing speed to have no practical use, etc.

SUMMARY OF THE INVENTION

This applicant, in order to solve the above-described problems heretofore, has been filing an application for a print head for injecting a recording solution while a pressure of a liquid chamber is varied by deformation induced during phase transforming procedure of a thin film shape memory alloy. According to the formerly filed print head, an actuating force of the thin film shape memory alloy is increased for decreasing the clogging of a nozzle, the thin film shape memory alloy has so large deforming quantity for allowing for fabrication of the thin film shape memory alloy in small size to heighten the compactness of the nozzle to enhance resolution, and the thin film shape memory alloy can be attached onto a substrate by using a semiconductor process to enhance mass productivity.

The present invention relates to an improvement of the formerly filed print head. Accordingly, it is an object of the present invention to provide an apparatus for injecting a recording solution of a print head, wherein the buckling force of the thin film shape memory alloy is increased by a pressure lower than an atmospheric pressure when the thin film shape memory alloy is buckled to its original state during being cooled, so that time required for refilling the liquid chamber after the recording solution is injected, i.e., operating frequency, is increased to enhance printing performance.

To achieve the above object of the present invention, there is provided an apparatus for injecting a recording solution of a print head including thin film shape memory alloys having a phase transformed in accordance with a temperature variation, and an electric power supply section for inciting the temperature variation of the thin film shape memory alloys. Also, a substrate having space portions forcibly transforms the phase of the thin film shape memory alloys by a pressure lower than an atmospheric pressure when the thin film shape memory alloys are coupled to the upper portion thereof, and a passage plate installed to the upper portion of the substrate is formed with liquid chambers for retaining the recording solution to the direct upper portion of the thin film shape memory alloys and a feed path in one sides of wall planes surrounding the liquid chambers for introducing the recording solution. A nozzle plate is installed over the passage plate and formed with nozzles having dimensions smaller than those of the liquid chambers of the passage plate for enabling the recording solution to be injected in the form of droplet when the phase of the thin film shape memory alloys is transformed.

The present invention is contrived for solving the drawbacks of the conventional systems of using the piezo-electric device and air expansion by heating and of the conventional system of using the shape memory alloy. Thus, the the thin film shape memory alloy is formed on a substrate via a semiconductor thin film shape memory alloy fabricating process, and the substrate is partially etched to provide a space portion for allowing the thin film shape memory alloy to vibrate. In turn, the droplet is formed by the vibration of the thin film shape memory alloy.

According to the present invention, the simplified thin film shape memory alloy is embodied via the semiconductor thin film shape memory alloy fabricating process and substrate etching process, and the pressure difference is utilized to easily acquire the displacement required for injecting the recording solution, thus significantly enhancing the mass production. In addition, the magnitude of the pressure difference can be changed to easily attain the required displacement quantity, which also permits the displacement quantity to increase, making it possible to reduce the dimensions of the thin film shape memory alloy. Consequently, the head can be formed to be small in size and the compactness of the nozzles is heightened to attain the high resolution.

Furthermore, the thin film shape memory alloy is utilized to greatly cut down the power dissipation when performing the heating operation and to quicken the cooling time when performing the cooling operation. Additionally, no residual vibration occurs when the thin film shape memory alloy is buckled to the bending-deformed state by the residual compressive stress after injecting the recording solution, thereby being capable of performing stabilized injection of the recording solution with the consequence of increasing the operating frequency, i.e., enhancing the printing speed.

BRIEF DESCRIPTION OF THE DRAWINGS

The above objects and other advantages of the present invention will become more apparent by describing in detail preferred embodiments thereof with reference to the attached drawings in which:

FIGS. 6A to 6D are side section views showing the injecting apparatus according to one embodiment of the present invention, in which FIGS. 6A to 6D illustrate the states of being before/after the operation;

DETAILED DESCRIPTION OF THE PREFERRED EMBODIMENTS

Figure 1:
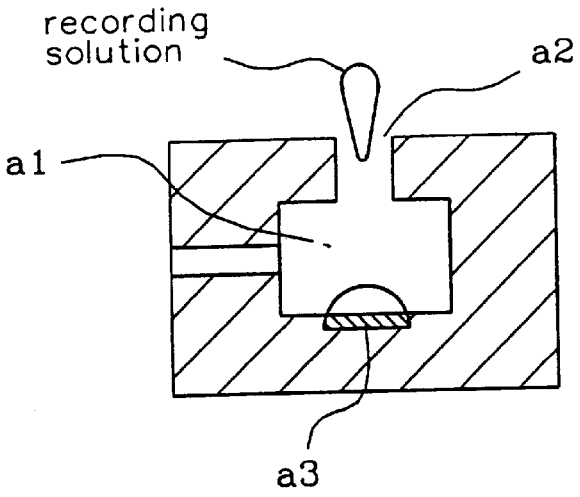
FIG. 1 is a sectional view showing a conventional heating-type injecting apparatus.
Figure 2:
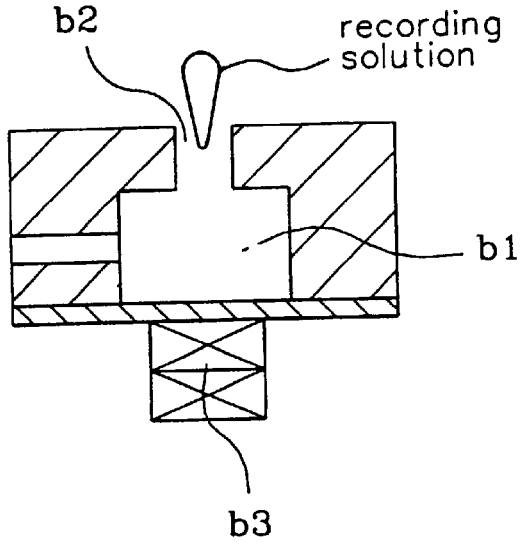
FIG. 2 is a sectional view showing a conventional piezo-electric type injecting apparatus.
Figure 3:
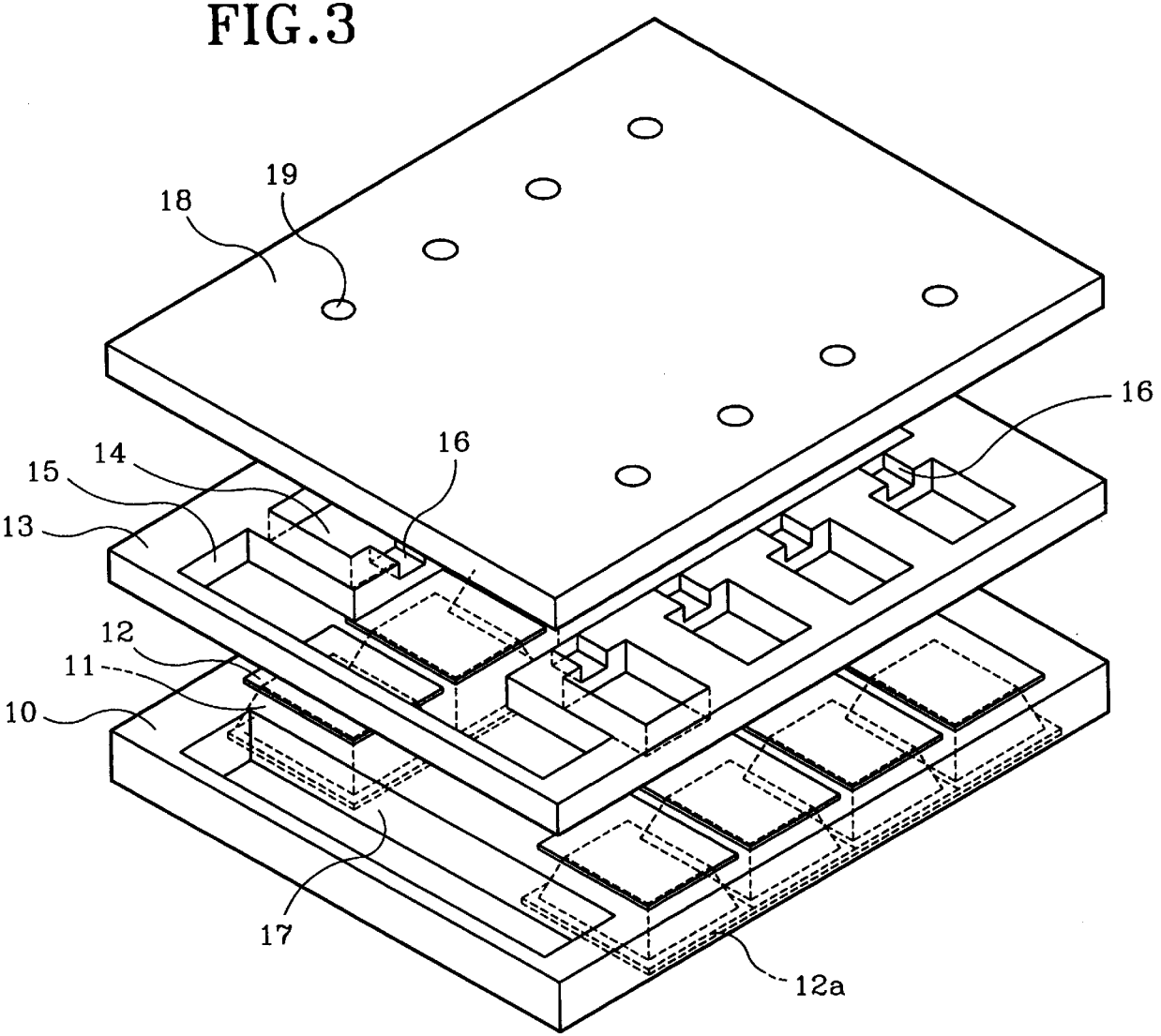
FIG. 3 is an exploded perspective view showing an injecting apparatus according to one embodiment of the present invention.
Figure 4:
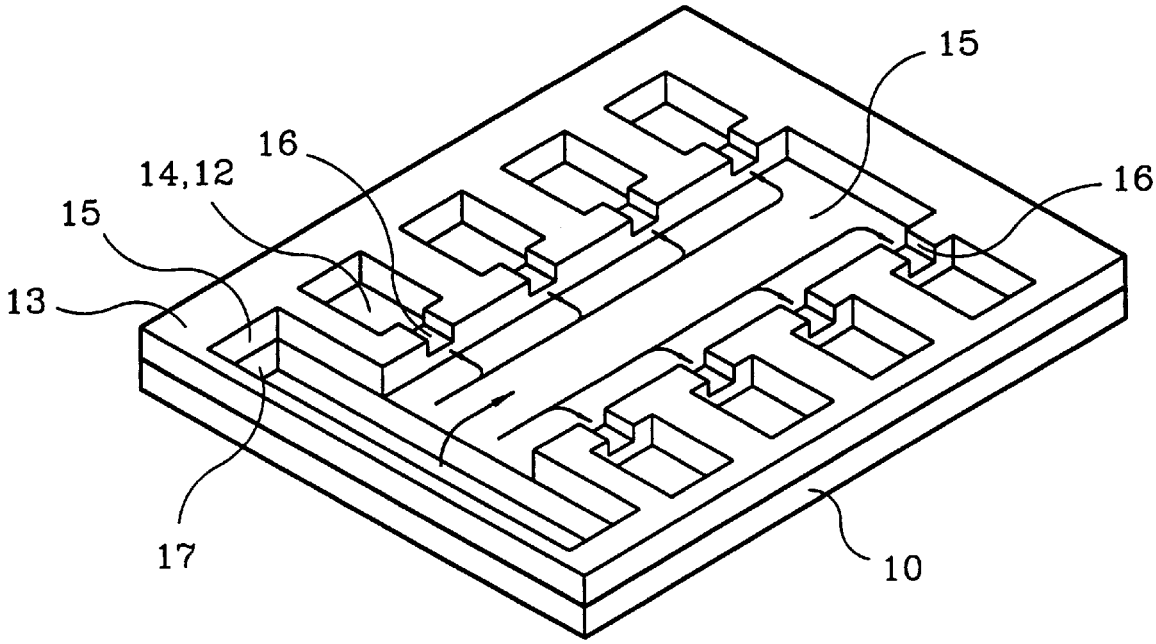
FIG. 4 is a perspective view showing the flow of a recording solution according to one embodiment of the present invention.

FIG. 3 is an exploded perspective view showing an injecting apparatus according to one embodiment of the present invention, and FIG. 4 is a perspective view showing the flow of a recording solution according to one embodiment of the present invention. The injecting apparatus according to the present invention is constructed such that a plurality of nozzles 19 for injecting a recording solution 20 are arranged in both rows and columns to heighten resolution, and thin film shape memory alloys 12 for substantially injecting recording solution 20 correspond to respective nozzles 19 one by one.

In more detail, a plurality of space portions 11 are provided to the front and rear sides of a substrate 10 while penetrating therethrough in the up and down direction, and plurality of thin film shape memory alloys 12 are joined to the upper portion of substrate 10 for covering respective space portions 11. A pressure plate 12*a* is joined to the lower surface of substrate 10 for permitting space portion 11 to be in a state of being lower than an atmospherical pressure. When pressure plate 12*a* is joined, the interior of space portion 11 has the pressure lower than the atmospheric pressure to forcibly bend-deform thin film shape memory alloy 12 in accordance with a vacuum factor therein. Therefore, the bending deformation speed (buckling force) of thin film shape memory alloy 12 is increased to heighten the operating frequency.

A passage plate 13 covers the upper portion of substrate 10, which is formed with liquid chambers 14 for retaining recording solution 20 at the direct upper portions of corresponding thin film shape memory alloys 12. Also, a feed path 15 for flowing recording solution 20 therethrough is provided into the center of passage plate 13 in such a manner that feed path 15 is mutually communicated with corresponding liquid chamber 14 via flow passages 16. A pouring entrance 17 communicated with feed path 15 at one side of passage plate 13 is provided to one side of substrate 10 for supplying recording solution 20 toward feed path 15.

A nozzle plate 18 is joined to the upper portion of passage plate 13, which is formed with plurality of nozzles 19 corresponding to respective liquid chambers 14 formed into passage plate 13. Respective nozzles 19 correspond to thin film shape memory alloys 12 exposed to corresponding liquid chamber sides. Thus, while the pressure of corresponding liquid chambers 14 is changed when thin film shape memory alloys 12 are deformed, recording solution 20 is injected through respective nozzles 19 in the state of droplet onto a sheet of printing paper. The phase of thin film shape memory alloys 12 is successively transformed in accordance with a temperature variation. During the phase transforming procedure, vibration occurs by the resulting deformation and recording solution 20 is injected through respective nozzles 19 in the form of droplet.

FIGS. 6A to 6D are side section views of the injecting apparatus according to one embodiment of the present invention, which illustrate an individual thin film shape memory alloy taken away. When thin film shape memory alloy 12 is heated up to be over a preset temperature under the state that thin film shape memory alloy 12 is in the initial state of being deformed to bulge out toward the opposite side of nozzle 19, it is to be flattened by being changed into the parent phase. At this time, the internal pressure of liquid chamber 14 is increased to be compressed and, simultaneously, recording solution 20 is injected through nozzle 19. Meantime, space portion 11 maintains the state that the internal vacuum factor is increased.

Thereafter, thin film shape memory alloy 12 is buckled to bulge as its original state once it is decreased down to be below the preset temperature, and recording solution 20 is introduced into the interior of liquid chamber 14 by the capillary action and inhaling force while the internal pressure of liquid chamber 14 is gradually lowered. Also, thin film shape memory alloy 12 under the buckling state is forcibly drawn to increase the buckling force, thereby accelerating the introducing speed of recording solution 20. That is, when thin film shape memory alloy 12 is deformed into the original bulging state, thin film shape memory alloy 12 is drawn for making the initial state of the inside of space portion 11 have the state of being lower than the atmospheric pressure. In other words, the vacuum factor of space portion 11 intensifies the buckling force of thin film shape memory alloy 12 to enable the buckling to the bending-deformed state within a short time period. As the result, the recording solution rapidly refills to be instantaneously injected, thereby increasing the operating speed of the print head.

Figure 5A:
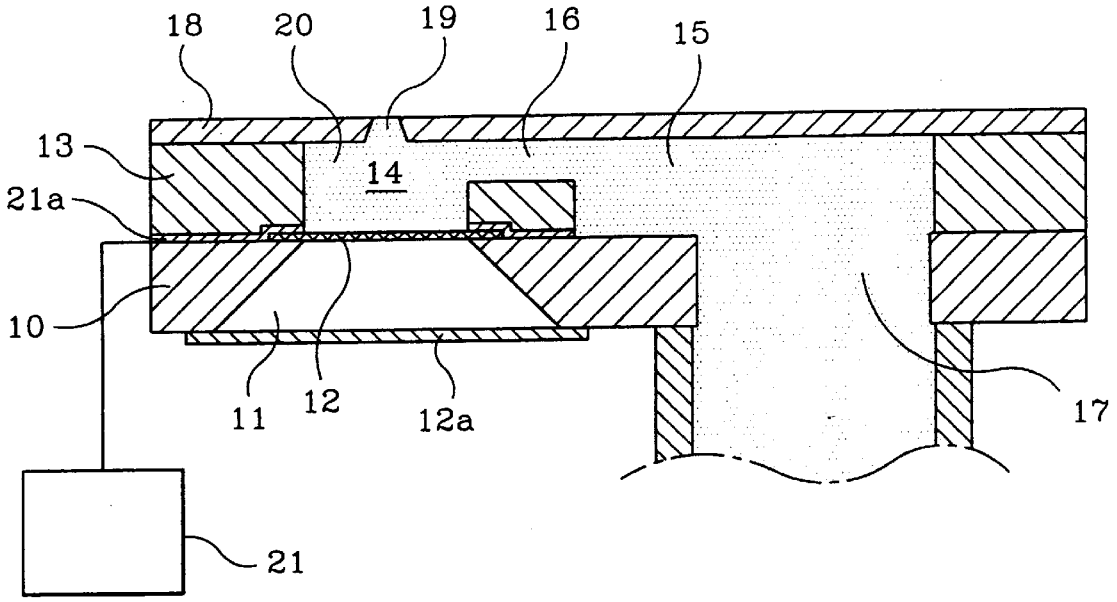
FIGS. 5A and 5B are front section views showing the injecting apparatus according to one embodiment of the present invention.
Figure 5B:
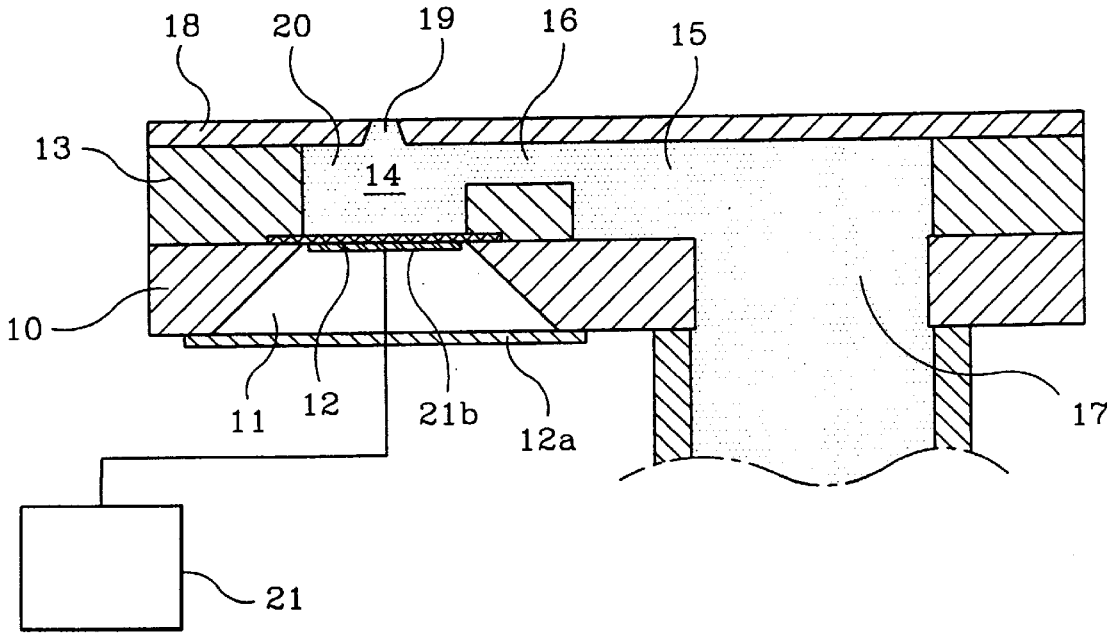

Thin film shape memory alloy 12 is heated by a power supply section 21 to involve the temperature variation as shown in FIG. 5A. That is, once the electric power of power supply section 21 is applied to electrodes 21*a* connected to both ends of thin film shape memory alloy 12, thin film shape memory alloy 12 generates heat by its own resistance to have the temperature raised and is changed into the parent phase to be straightened. Unless the electric power is applied to power supply section 21, thin film shape memory alloy 12 is naturally cooled to be buckled into the original bulging state by the pressure difference. Here, a heater 21*b* heated by the electric power of power supply section 21 as shown in FIG. 5B is directly attached to one side of thin film shape memory alloy 12 to heat it.

Figure 8:
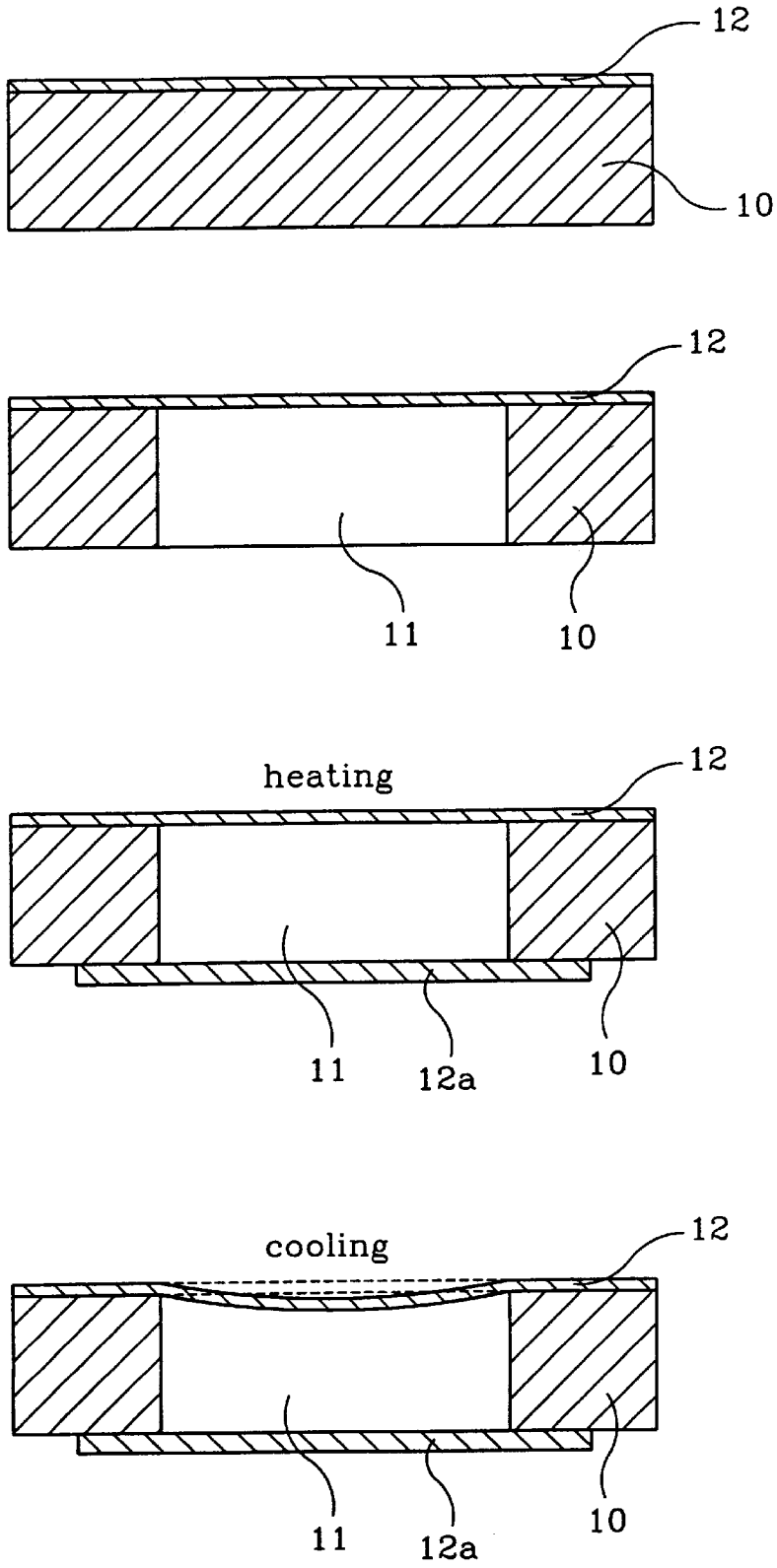
FIG. 8 is views for showing a manufacturing process of an one-way thin film shape memory alloy according to the present invention.
Figure 9:
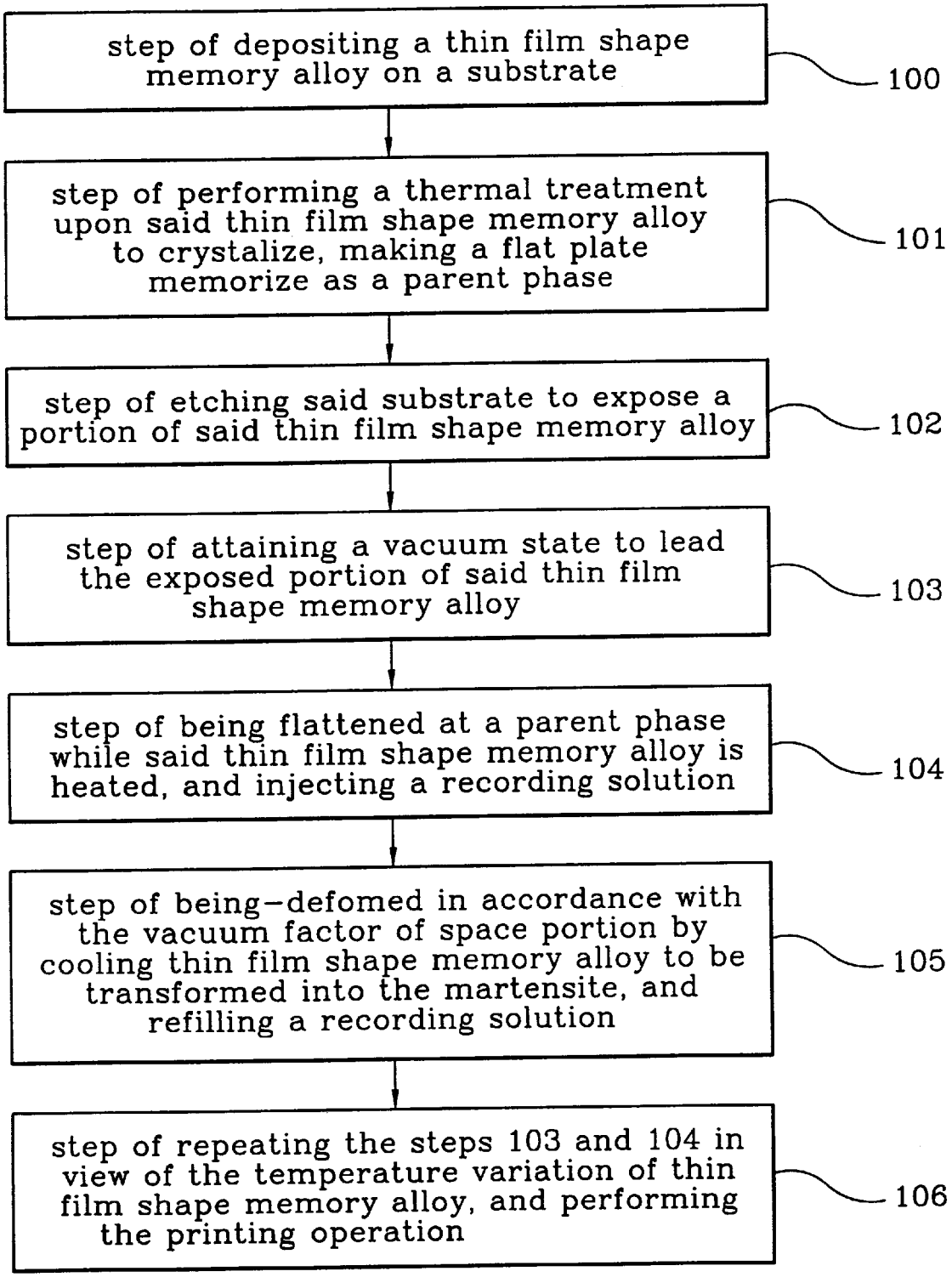
FIG. 9 is a block diagram showing the manufacturing process of the one-way thin film shape memory alloy according to the present invention.

A shape memory alloy having a shape changed according to a temperature to result in deformation is employed as thin film shape memory alloy 12, which is mainly formed of titanium Ti and nickel Ni to have a thickness of about 0.3 $\mu$m to 5 $\mu$m. Thin film shape memory alloy 12 consisting of the shape memory alloy has a directional property in accordance with a manufacturing method. FIGS. 8 and 9 are a flowchart and a block diagram respectively showing a manufacturing process of an one-way thin film shape memory alloy according to the present invention. FIGS. 3 to 6 are views presented by using the one-way thin film shape memory alloy. In step 100, thin film shape memory alloy 12 is deposited onto substrate 10 consisting of a substance such as a silicon. The deposition is mainly performed via a sputter-deposition and a laser ablation.

When it is subjected to a heat treatment at a regular temperature for a given period of time, thin film shape memory alloy 12 is to have the flat plate shape in a parent phase in step 101. Thereafter, the parent phase is being transited to a martensite while being cooled down by a martensite finishing temperature Mf of about 40° C. to 70° C.

When the direct lower portion of thin film shape memory alloy 12 is etched, space portion 11 is formed into substrate 10 consisting of a silicon wafer to externally expose thin film shape memory alloy 12 in step 102. Then, pressure plate 12*a* is attached to the bottom plane of substrate 10 formed via the etching and the interior of space portion 11 becomes in the vacuum state by being adhered in the vacuum state in step 103.

Figure 6A:
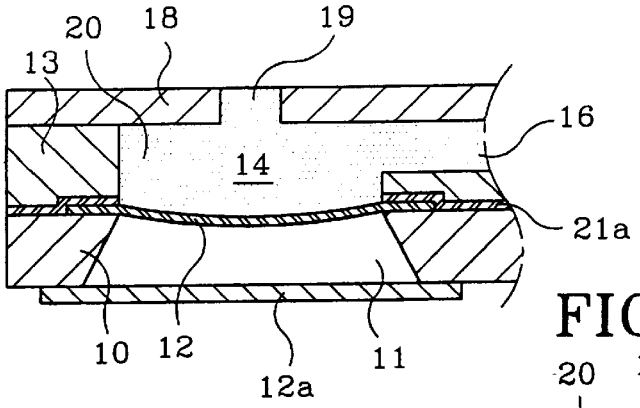
Figure 6B:
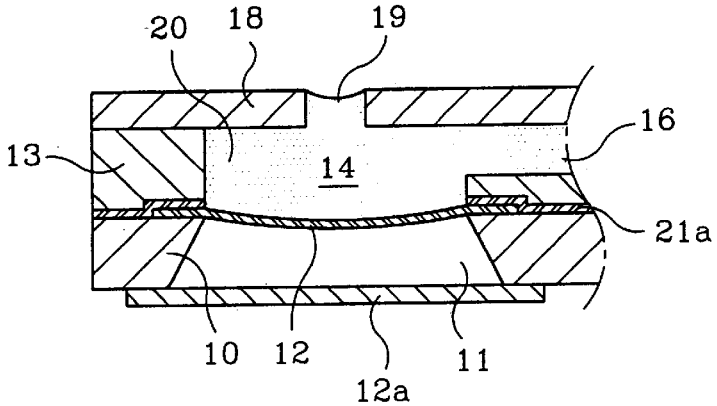
Figure 6C:
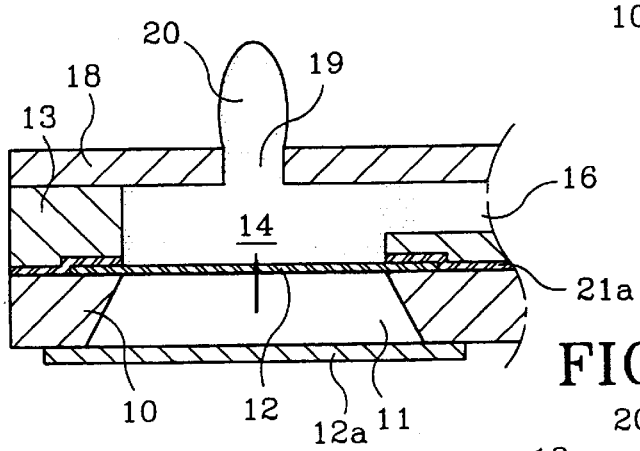
Figure 6D:
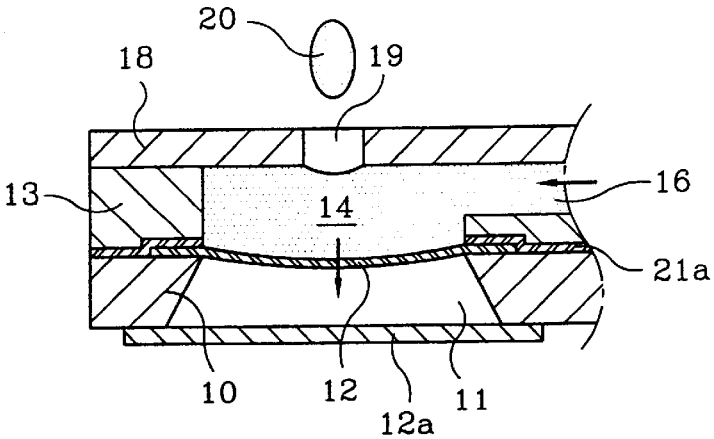
Figure 7:
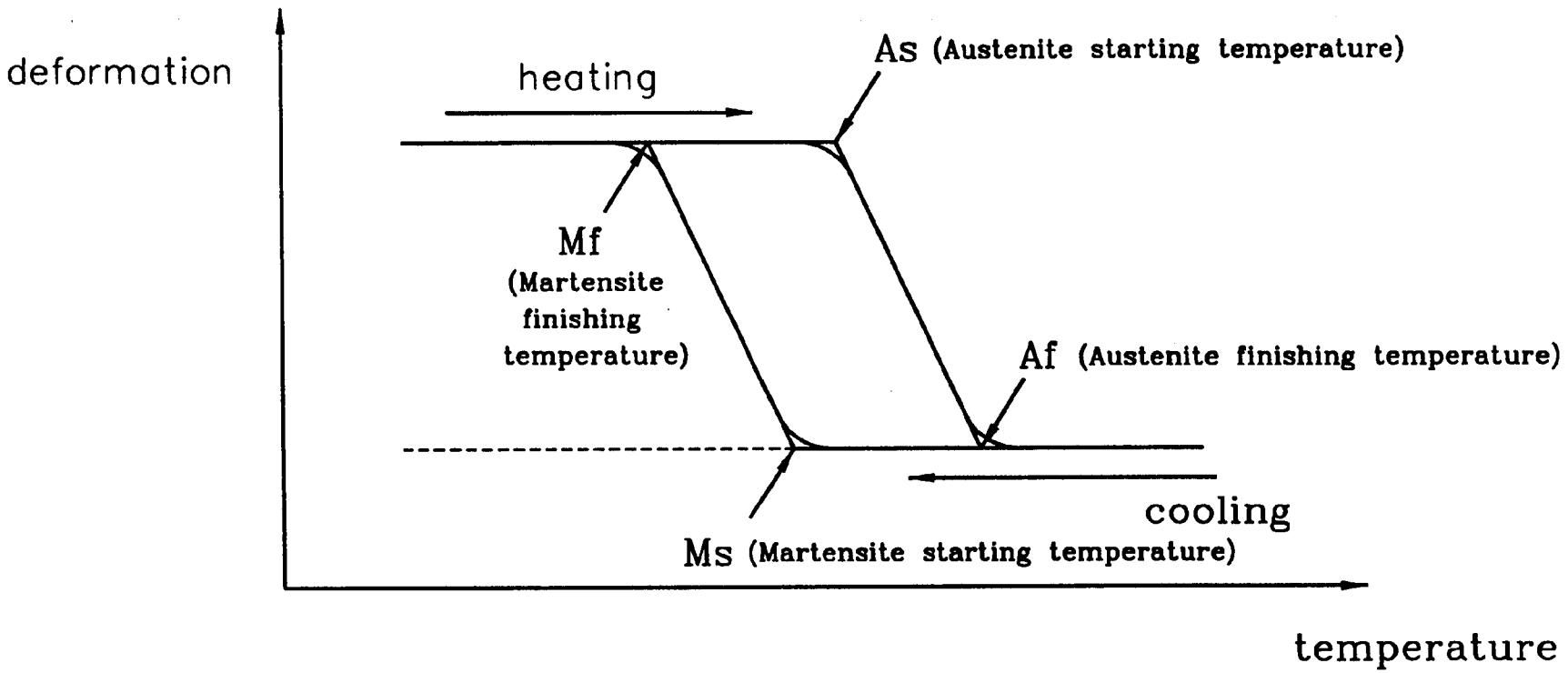
FIG. 7 is a graph representation plotting the phase transformation of a thin film shape memory alloy according to the present invention.

In step 104, if thin film shape memory alloy 12 bending-deformed at the martensite is applied a preset temperature, i.e., an austenite finishing temperature Af of approximately 50° C. to 90° C., recording solution 20 is injected while it is being flattened as shown in FIG. 6C. Then, by cooling thin film shape memory alloy 12 to be transformed into the martensite, in step 105, it is bending-deformed in accordance with the vacuum factor of space portion 11 and recording solution 20 refills the interior of liquid chamber 14. Then, the above steps 103 and 104 are repeatedly performed in view of the temperature variation of thin film shape memory alloy, and step 106 of executing the printing operation is performed in the course of the aforementioned steps.

Figure 10:
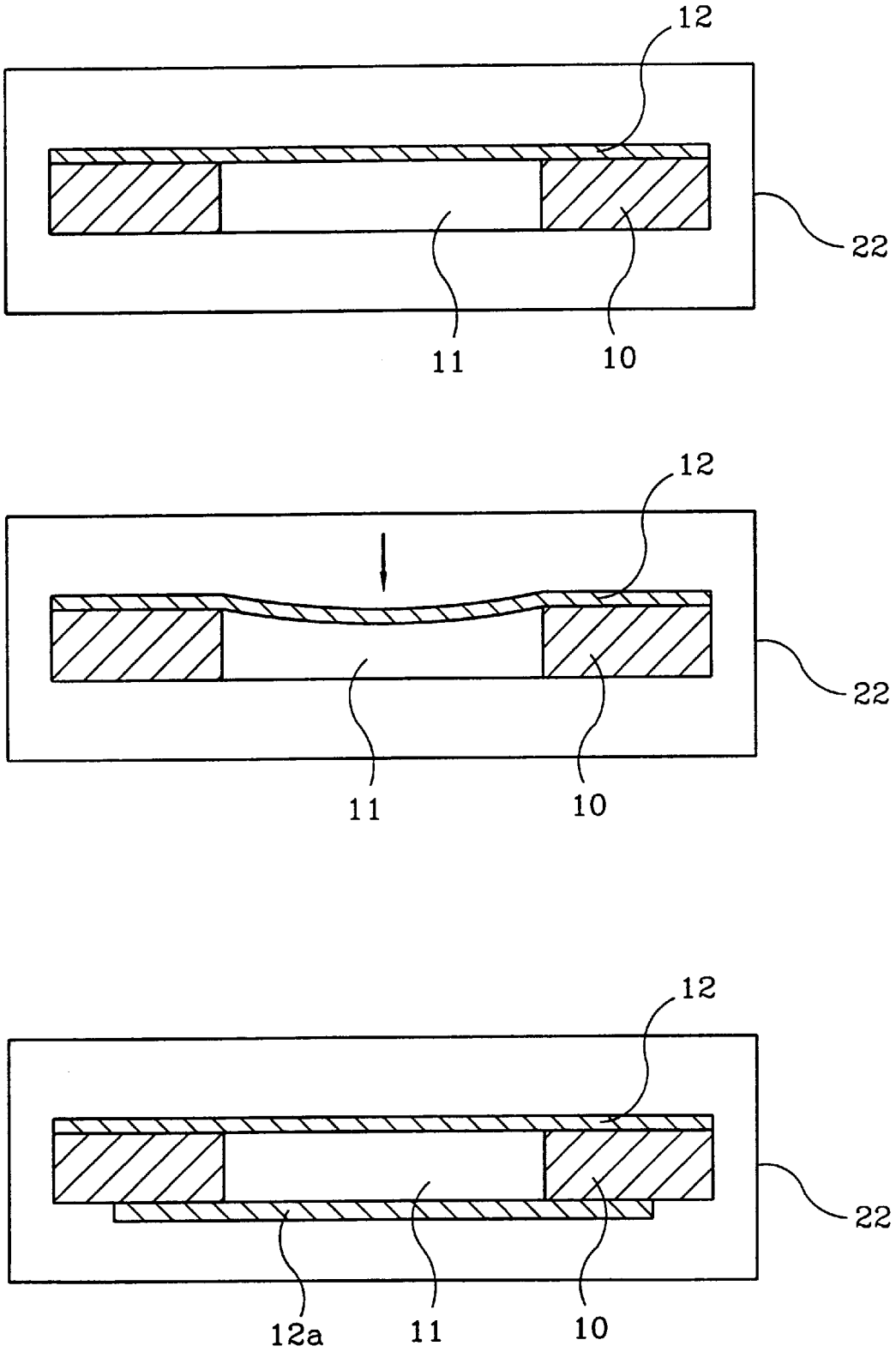
FIG. 10 is views for showing a manufacturing process of a two-way thin film shape memory alloy according to the present invention.
Figure 11:
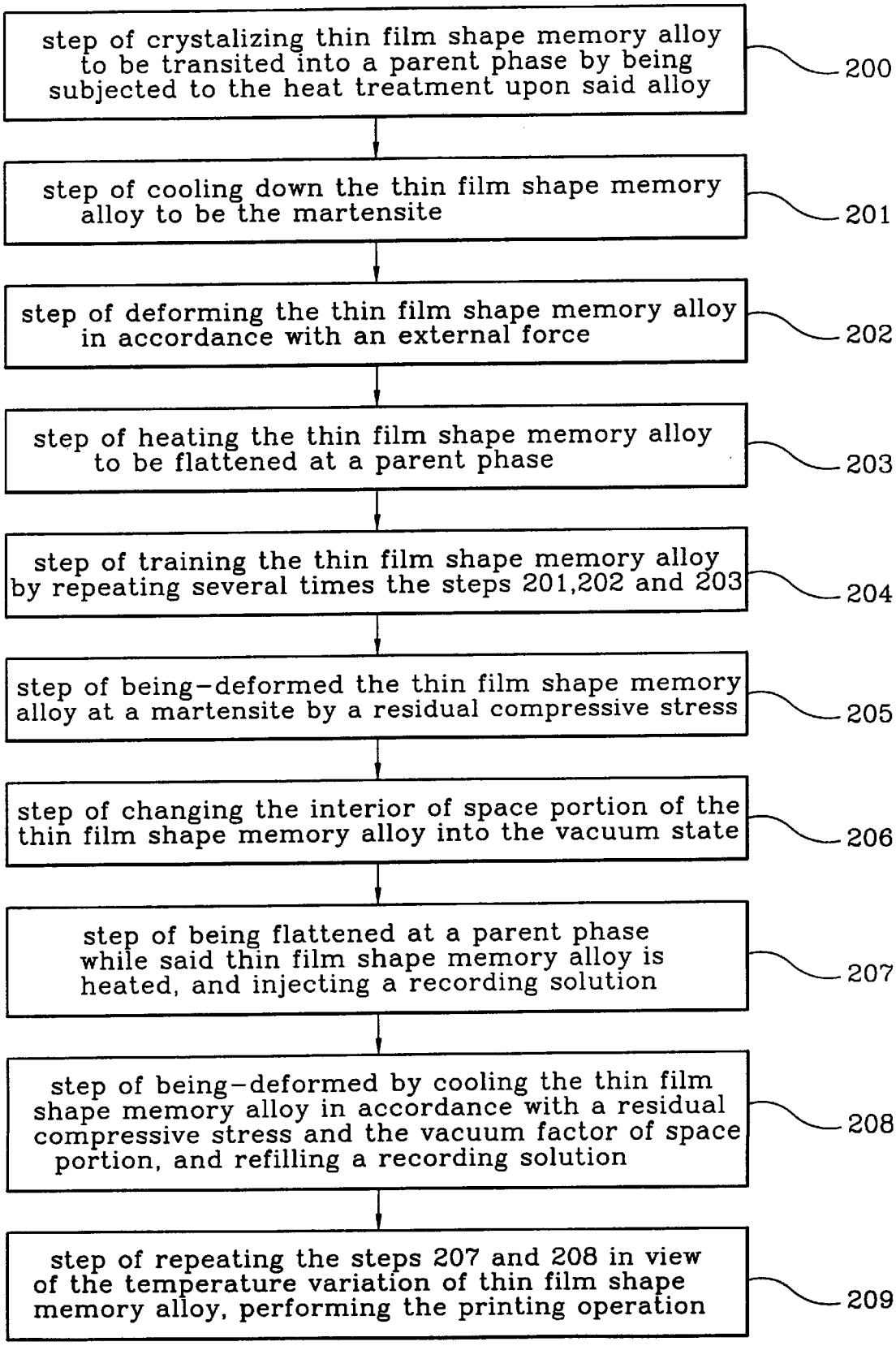
FIG. 11 is a block diagram showing the manufacturing process of the two-way thin film shape memory alloy according to the present invention.

FIGS. 10 and 11 are flowchart and a block diagram respectively showing a manufacturing process of a two-way thin film shape memory alloy according to the present invention. Here, in step 200, thin film shape memory alloy 12 is transited into the austenite by being subjected to the heat treatment at a regular temperature for a given period of time within a chamber 22. Then, upon the cooling down to be below the martensite finishing temperature Mf of approximately 4020 C. to 70° C., the austenite is changed into the martensite in step 201. Also, the martensite is deformed by being applied with an external force within an extent of inhibiting a plastic sliding thereon in step 202. After this, when thin film shape memory alloy 12 is heated by the austenite finishing temperature Af of approximately 50° C. to 90° C., it is transformed into the austenite to be flattened in step 203.

Then, the above-described steps 201, 202 and 203 are repeated several times to train thin film shape memory alloy 12 in step 204. By doing so, regardless of the lack of the external force, thin film shape memory alloy 12 is deformed in step 205 when the temperature of thin film shape memory alloy 12 is dropped down to the martensite finishing temperature Mf in training step 204. Thereafter, pressure plate 12*a* is attached to the bottom plane of substrate 10 formed via an etching and is subjected to an electrostatic junction under the vacuum state, so that the interior of space portion 11 is changed into the vacuum state in step 206.

In step 207, when thin film shape memory alloy 12 is heated by the austenite finishing temperature Af, recording solution 20 is injected while it is being flattened. Upon cooling down thin film shape memory alloy 12 to be transformed into the martensite, thin film shape memory alloy 12 is bending-deformed in accordance with its own force and the vacuum factor while recording solution 20 refills the interior of liquid chamber 14 in step 208. The above steps 207 and 208 are repeated in accordance with the temperature variation of thin film shape memory alloy 12, and step 209 of executing the printing operation is performed in the course of the aforementioned steps. In other words, while thin film shape memory alloy 12 actuates the two-way reciprocating motion according to the temperature, it injects recording solution 20. Additionally, the quantity of bending deformation of the two-way thin film shape memory alloy is decided in accordance with the extent of applying the external force during the manufacturing process thereof to make it possible to easily embody the displacement quantity required.

Thin film shape memory alloy 12 having the two-way directional property may be applied to one embodiment of the present invention as shown in FIG. 6. For example, after space portion 11 is formed to one side of substrate 10, trained thin film shape memory alloy 12 is formed onto substrate 10. At this time, by fixing thin film shape memory alloy 12 onto one side of substrate 10 under the state of covering space portion 11, thin film shape memory alloy 12 is deformed by centering about space portion 11 when the temperature is changed to be capable of injecting recording solution 20. Once thin film shape memory alloy 12 is bending-deformed to its initial state by the cooling, it is bending-deformed in accordance with its own force and the vacuum factor of space portion 11 to increase the buckling force.

Since thin film shape memory alloy 12 according to the present invention is flattened at the austenite and is bending-deformed at the martensite formation in accordance with the temperature difference, the frequency (i.e., operating frequency) of thin film shape memory alloy 12 is increased as the temperature difference becomes smaller. For this reason, copper Cu may be added into the alloy of titanium Ti and nickel Ni for decreasing the temperature difference which transforms the phase. The shape memory alloy using titanium Ti, nickel Ni and copper Cu decreases the phase-transforming temperature variation to increase the frequency, i.e., the operating frequency, of thin film shape memory alloy 12, thereby heightening the printing speed.

The possibility of embodying the droplet of the thin film shape memory alloy according to the present invention formed as above is interpreted as follows.

Assuming that the diameter of the droplet is 60 $\mu$m produced in case that an energy density $W_{max}$ generated by the thin film shape memory alloy is $10\times10^6$J/m$^3$ in maximum and the volume V of the thin film shape memory alloy is $200\times200\times1$ $\mu$m$^3$, the injectability of the thin film shape memory alloy is judged as below:

$$U = U_s + U_K$$

$$U_s = \pi R_2 \gamma$$

$$U_K = \frac{1}{12}\pi\rho R^3 v^2$$

where a reference symbol U denotes the energy required for generating the desired droplet of the recording solution; $U_S$, a surface energy of the recording solution; $U_K$, a kinetic energy of the recording solution; R, a diameter of the droplet; v, velocity of the recording solution; ρ, a density of the recording solution (1000 kg/m$^3$) ; and γ, a surface tension (0.073N/m) of the recording solution. Here, providing that the velocity of the desired droplet is 10 $\mu$m/sec, required energy U can be written as:

$$U=2.06\times10^{-10}+7.07\times10^{-10}=9.13\times10^{-10}J$$

Also, the maximum energy generated by the thin film shape memory alloy is defined as:

$W_{max=Wv}\cdot V$ (where $W_v$ denotes the energy J/m$^3$ exercisable per unit volume of the thin film shape memory alloy, and V denotes the volume of the thin film shape memory alloy). That is, $$W_{max}=(10\times10^6)\cdot(200\times200\times1)=4\times10^{-7}\text{J}$$

When the diameter of the droplet is 100 $\mu$m, required energy U equals $3.85\times10^{-9}$J.

Therefore, since $W_{max}>U$, the droplet of desired dimensions can be embodied. In other words, since the thin film shape memory alloy has the considerably great actuating force, the desired droplet of the recording solution can be easily embodied.

Furthermore, the heating time and dissipated energy of one embodiment of the present invention can be analyzed as follows. The electric power is applied to thin film shape memory alloy 12 to generate the heat by the resistance and the phase is to be transformed by the heat generated, only that the heating time and dissipated energy until thin film shape memory alloy 12 of 25° C. is heated to be the austenite of 70° C. are obtained as below.

Here, a substance of the thin film shape memory alloy is TiNi; a length l of the thin film shape memory alloy is 400 $\mu$m; a density $\rho_s$ of the thin film shape memory alloy is 6450 kg/m$^3$ and quantity of the temperature variation ΔT is 45° C. by 70 minus 25. Also, a specific heat $C_\rho$is 230 J/Kg° C.; a specific resistance ρ of the thin film shape memory alloy is 80 $\mu$·cm; applied current I is 1.0 A; a width w of the thin film shape memory alloy is 300 $\mu$m; and the height t of the thin film shape memory alloy is 1.0 $\mu$m. Accordingly, heating time $t_h$ is obtained by $$\begin{aligned} t_h &= \rho_s \Delta T C_p \frac{(W\cdot t)^2}{\rho\cdot I^2} \\ &= 7.4\,\mu\text{sec} \end{aligned}$$

Thus, since resistance R of the thin film shape memory alloy, i.e., ρ(I/w·t) is 1.1 ω and dissipated electric power $I^2R$ is 1.1 Watt, the energy required for generating the droplet is obtained by:

$$\text{heating time}\times\text{dissipated electric power}=8.1\ \mu\text{J}$$

Therefore, the energy required for producing the droplet by injecting recording solution 20 is roughly 8.1 $\mu$J which is decreased to be smaller than the conventional energy dissipation of 20 $\mu$J that has been required for the conventional heating system.

Figure 12:
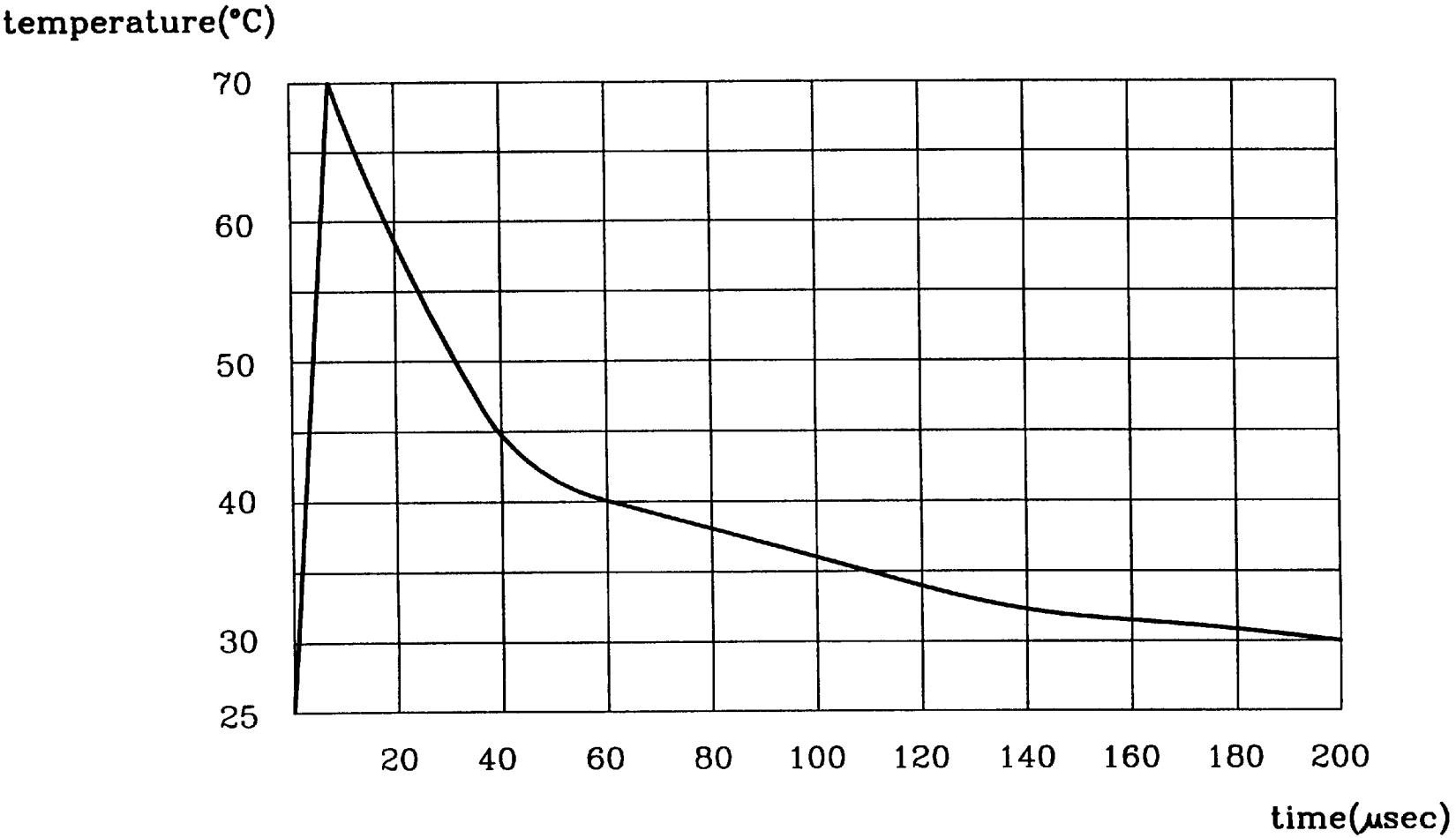
FIG. 12 is a graph representation plotting the heating time and temperature of the thin film shape memory alloy according to the present invention.
Figure 13:
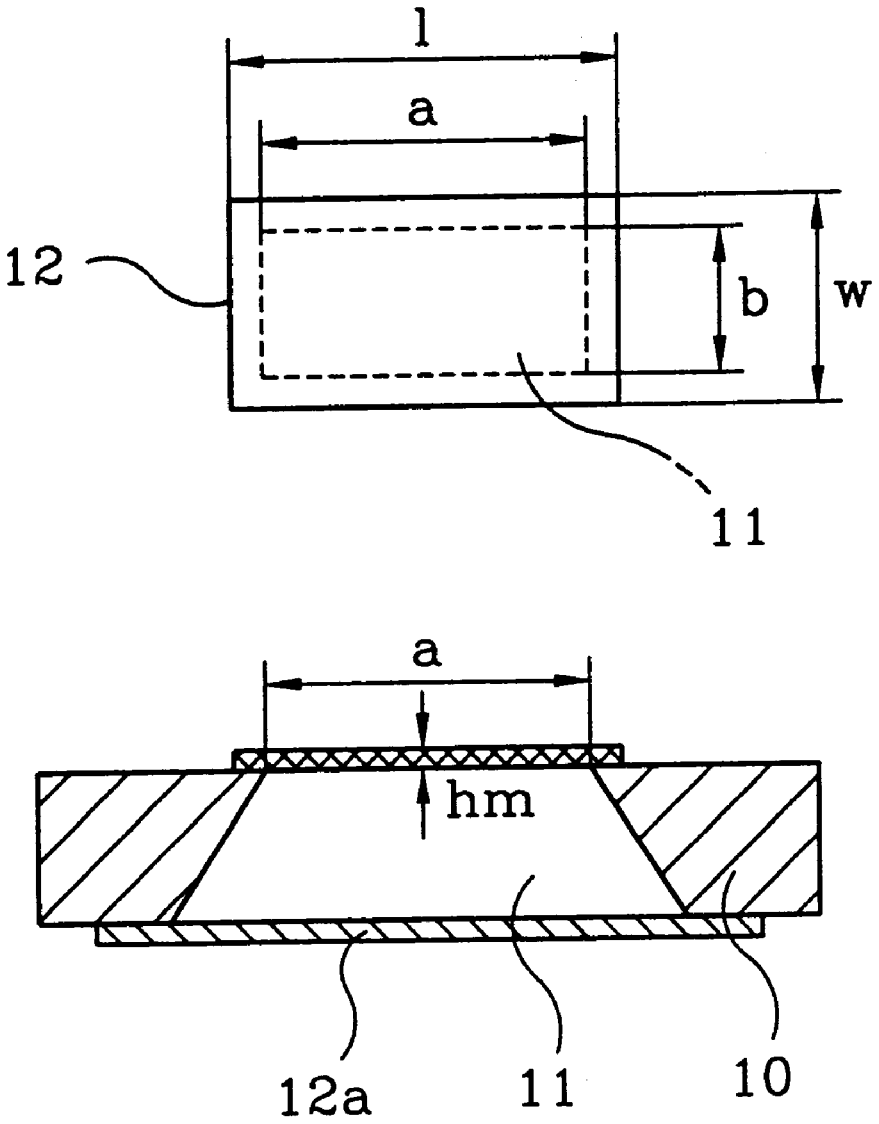
FIG. 13 is a section view showing the dimensions of the thin film shape memory alloy according to the present invention.

FIG. 12 is a graph representation plotting the heating time and temperature of the thin film shape memory alloy according to the present invention, in which the material values for performing the experiment are as follows.

Here, the thickness of thin film shape memory alloy 12 is 1 m and the surrounding temperature is 25° C.

| | Recording solution(water) | Air | Thin film (TiNi) | Substrate (Si) |
|---|---|---|---|---|
| Density (kg/m$^3$) | 1000 | 1 | 6400 | 2330 |
| Specific heat (J/kg · k) | 4179 | 1000 | 230 | 890 |
| Coefficient of heat transfer | 0.566 | 0.026 | 23 | 124 |

Under the state that the surrounding temperature is 25° C., the time required for heating thin film shape memory alloy 12 up to 70° C. to be transited into the austenite to cool down it to 30° C. is roughly 200 μsec which is approximately 5 kHz when being calculated in terms of the frequency. Accordingly, the operating frequency of the print head is 5 kHz or so. However, since the temperature of completely finishing the deformation (the martensite finishing temperature) is about 45° C., there is no need to wait for being cooled down to 30° C. but it can be heated again in advance to be able to continuously inject recording solution 20. Due to this fact, the operating frequency can be heightened to be over 5 kHz. Once the operating frequency becomes large, the printing speed is increased.

Also, the calculation of the displacement quantity of the thin film shape memory alloy and the relation of energy loss during injecting the recording solution by the pressure lower than the atmospheric pressure are described hereinbelow.

When the dimension of the thin film shape memory alloy is obtained by 200×200 μm (a=b=200 m) and the thin film shape memory alloy is formed of TiNi, the relation between the pressure and displacement is written as:

$$P = \frac{\delta h}{L^2}\left(f(\nu)\cdot\frac{E_\delta}{1-\nu}\cdot\frac{\delta^2}{L^2} + c\sigma_0\right)$$

where a reference symbol P denotes a pressure difference; f(ν)=1.98−0.585 σ where ν denotes Poisson's ratio; $E_o$denotes Young's
modulus that is herein 30 Gpa;

$$L = \frac{a}{2},$$

i.e., the central distance (100 μm) of a regularly-squared thin film shape memory alloy; σ, displacement quantity of the thin film shape memory alloy; $h_m$, the thickness (1.0 μm) of the thin film shape memory alloy; $\sigma_0$, residual stress; and c, a constant that is 3.41.

The pressure exerting upon the thin film shape memory alloy is almost the atmospheric pressure (100 KPa) while ignoring the residual stress of the thin film shape memory alloy. If the deforming quantity of the thin film shape memory alloy is obtained by the pressure while using the above equation, it is roughly 4.3 μm.

When the displacement of the thin film shape memory alloy is 4.3 μm, the volume variation ΔV is, $$\Delta V=(1/4)(W_o\cdot a^2)=4.3\times10^{-14}m^3$$

The energy W consumed by the pressure difference (atmospheric pressure) when the thin film shape memory alloy is straightened is defined as:

$$W=P\cdot\Delta V=4.3\times10^{-9}J$$

The maximum energy $W_{max}$ exerted by the thin film shape memory alloy (200×200×1 $\mu m^3$) is $$W_{max}=W_v\cdot V$$

where a reference symbol $W_v$ denotes the maximum energy ($10\times10^6 J/m^3$) capable of being exerted per unit volume of the thin film shape memory alloy; and V, the volume of the thin film shape memory alloy. Therefore, $$W_{max}=(10\times10^6)\cdot(200\times200\times1)=4\times10^{-1}J$$

Accordingly, the energy ratio $W/W_{max}$ consumed by the pressure lower than the atmospheric pressure is 1% as compared with the 10 maximum energy capable of being exerted by the thin film shape memory alloy. Thus, the influence by the pressure difference in injecting the recording solution is negligible.

In the injecting apparatus according to the present invention as described above, the thin film shape memory alloy for injecting the recording solution involves phase transformation in accordance with the temperature variation, and the recording solution is injected by the deformation caused during the phase transformation. Also, the space portion formed into the substrate maintains the state of being lower than the atmospheric pressure by the pressure plate. Consequently, the buckling force is reinforced by the vacuum factor when the thin film shape memory alloy is buckled into the initial state, thereby increasing the operating frequency. In addition, the thin film shape memory alloy has the great displacement quantity to make it possible to reduce respective space portions formed in the substrate and respective liquid chambers formed in the passage plate. Thus, the print head is decreased in overall size and is manufactured in small size, so that the compactness of the nozzles is heightened to be favorable to the attainment of high resolution.

Furthermore, since the actuating force is so large to increase the force of pushing out the recording solution, the clogging of the nozzle is decreased to enhance reliability. Also, the dimensions of the droplet of the recording solution can be sufficiently shrunken to be advantageous in attaining high picture quality. Additionally, the driving voltage is below 10 volts to facilitate the designing and manufacturing of the driving circuit, and the thin film shape memory alloy formed of the shape memory alloy is deposited onto the surface of the substrate formed of the silicon wafer by using the typical semiconductor process to be effective in enhancing the mass productivity and simplifying the structure thereof.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. An apparatus for injecting a recording solution of a print head comprising:

thin film shape memory alloys having a phase transformed in accordance with a temperature variation;

an electric power supply section for inciting said temperature variation of said thin film shape memory alloys;

a substrate having space portions for forcibly transforming said phase of said thin film shape memory alloys by a pressure lower than an atmospheric pressure when said thin film shape memory alloys are coupled to an upper portion of said substrate;

a passage plate installed to said upper portion of said substrate and formed with liquid chambers for retaining said recording solution to a direct upper portion of said thin film shape memory alloys and formed with a feed path in a side of a wall surrounding said liquid chambers for introducing said recording solution; and a nozzle plate installed over said passage plate and formed with nozzles having dimensions smaller than those of said liquid chambers of said passage plate for enabling said recording solution to be injected in droplet form when said phase of said thin film shape memory alloys is transformed.

2. An apparatus for injecting a recording solution of a print head as claimed in claim 1, wherein said thin film shape memory alloy is comprised of said shape memory alloy, using titanium (Ti) and nickel (Ni) as main substances.

3. An apparatus for injecting a recording solution of a print head as claimed in claim 2, wherein said thin film shape memory alloy is comprised of said shape memory alloy further added with copper (Cu) for heightening an operating frequency by reducing a temperature difference which incites the phase transformation.

4. An apparatus for injecting a recording solution of a print head as claimed in claim 1, wherein said thin film shape memory alloy has a thickness of ranging from 0.3 $\mu$m to 5 $\mu$m.

5. An apparatus for injecting a recording solution of a print head as claimed in claim 1, wherein said electric power supply section comprises electrodes connected to both ends of said thin film shape memory alloy for permitting said thin film shape memory alloy to generate heat through resistance.

6. An apparatus for injecting a recording solution of a print head as claimed in claim 1, wherein said electric power supply section comprises a heater attached to one side of said thin film shape memory alloy for being heated by using the supplied electric power.

7. An apparatus for injecting a recording solution of a print head as claimed in claim 1, wherein said substrate is comprised of a silicon.

8. An apparatus for injecting a recording solution of a print head as claimed in claim 7, wherein said substrate is provided with said space portions opened in the up and down sides, and said thin film shape memory alloys are coupled onto the upper portion of said space portions, and said substrate is formed with a pressure plate onto the lower side of said space portions for permitting the inside thereof to be in the state of being lower than said atmospheric pressure.

9. An apparatus for injecting a recording solution of a print head as claimed in claim 8, wherein said pressure plate is comprised of a polymer substance, and is adhered to said substrate by means of an adhesive between them in the vacuum state.

10. An apparatus for injecting a recording solution of a print head as claimed in claim 9, wherein said pressure plate is comprised of a glass substance having a thermal expansion coefficient and overall features similar to those of said silicon.

11. An apparatus for injecting a recording solution of a print head as claimed in claim 9, wherein said pressure plate is electrostatically bonded to said substrate in the vacuum state.

12. An apparatus for injecting a recording solution of a print head as claimed in claim 8, wherein an area of said thin film shape memory alloy substantially phase-transformed by being exposed to said space portion has a width ranging from 100 $\mu$m to 500 $\mu$m and a length ranging from 100 $\mu$m to 300 $\mu$m.

13. An apparatus for injecting a recording solution of a print head as claimed in claim 1, wherein said thin film shape memory alloy is changed into a form of a flat plate to inject said recording solution via said nozzle when being heated by over an austenite finishing temperature to be transformed into an austenite, and is bending-deformed in accordance with a vacuum state to refill said liquid chamber with said recording solution when being cooled down by below a martensite finishing temperature to be transformed into a martensite.

14. An apparatus for injecting a recording solution of a print head as claimed in claim 13, wherein said austenite finishing temperature is approximately 50° C. to 90° C., and said martensite finishing temperature is approximately 40° C. to 70° C.

15. An apparatus for injecting a recording solution of a print head as claimed in claim 13, wherein a length of time required for cooling down said thin film shape memory alloy to be said martensite after heating said austenite is shorter than approximately 200 $\mu$sec and an operating frequency is 5 kHz and higher.

16. An apparatus for injecting a recording solution of a print head as claimed in claim 1, wherein said thin film shape memory alloy is changed into the form of a flat plate to inject said recording solution via said nozzle when being heated by over an austenite finishing temperature to be transformed into an austenite, and is bending-deformed by an internal deformation regulating from training and vacuum state of said space portion to refill said liquid chamber with said recording solution when being cooled down by a martensite finishing temperature to be transformed into a martensite.

17. An apparatus for injecting a recording solution of a print head as claimed in claim 16, wherein, after said thin film shape memory alloy is trained by applying an external force several times when said thin film is of said martensite, said martensite is to have a desired displacement when being cooled down to below said martensite finishing temperature.

18. An apparatus for injecting a recording solution of a print head as claimed in claim 16, wherein said austenite finishing temperature is approximately 50° C. to 90° C., and said martensite finishing temperature is approximately 40° C. to 70° C.

19. An apparatus for injecting a recording solution of a print head as claimed in claim 16, wherein the time required for cooling down to be said martensite after heating by said austenite is shorter than approximately 200 $\mu$sec and said operating frequency is 5 kHz and higher.

20. A method of injecting a recording solution of a print head comprising:

a step of depositing a thin film shape memory alloy on a substrate;

a step of performing a thermal treatment upon said thin film shape memory alloy to memorize a flat plate shape as a parent phase;

a step of etching said substrate to expose a portion of said thin film shape memory alloy;

a step of attaining a vacuum state to lead the exposed portion of said thin film shape memory alloy to have a state of being lower than the atmospheric pressure; and a step of injecting said recording solution while said thin film shape memory alloy is heated to be changed into an austenite by said respective steps, and refilling the inside of a liquid chamber with said recording solution while said thin film shape memory alloy is bending-deformed by a residual compressive stress and vacuum state when being cooled to be changed into a martensite.

21. A method of making a print head, wherein said print head uses a thin film shape memory alloy for injecting a recording solution, comprising the steps of:

depositing a thin film shape memory alloy on a substrate;

performing a thermal treatment upon said thin film shape memory alloy to crystallize, making a flat plate memorize as a parent phase;

etching said substrate to expose a portion of said thin film shape memory alloy; and, attaining a vacuum state to lead said exposed portion of said thin film shape memory alloy to have a state of being lower than an atmospheric pressure.

22. A method of using a print head, wherein said print head uses a thin film shape memory alloy for injecting a recording solution, comprising the step of:

injecting said recording solution while said thin film shape memory alloy is heated to be changed into an austenite, and refilling the inside of a liquid chamber with said recording solution while said thin film shape memory alloy is bending-deformed by a residual compressive stress and vacuum state when being cooled to be changed into said martensite.

* * * * *